United States Patent [19]

Suzuki et al.

[11] 4,091,066

[45] May 23, 1978

[54] PROCESS FOR PRODUCING FLAME RETARDANT ACRYLIC FIBERS WITH IMPROVED PROPERTIES

[75] Inventors: Hiroshi Suzuki; Shigeru Sawanishi; Takamaro Kusunose, all of Okayama, Japan

[73] Assignee: Japan Exlan Company Limited, Osaka, Japan

[21] Appl. No.: 703,114

[22] Filed: Jul. 6, 1976

[30] Foreign Application Priority Data

Jul. 4, 1976 Japan ..... 51-83039

[51] Int. Cl.[2] ..... D01F 6/18

[52] U.S. Cl. ..... 264/182; 264/210 F; 264/211; 264/342 RE

[58] Field of Search ..... 264/182, 210 F, 342 RE, 264/211; 260/45.75 B

[56] References Cited

U.S. PATENT DOCUMENTS

| | | | |
|---|---|---|---|
| 3,451,140 | 6/1969 | Nakagawa et al. | 264/182 |
| 3,451,960 | 6/1969 | Schmidt | 264/182 |
| 3,784,666 | 1/1974 | Sekiguchi et al. | 264/182 |
| 3,798,296 | 3/1974 | Thomas | 264/171 |
| 3,847,864 | 11/1974 | Chase et al. | 260/45.75 B |
| 3,864,447 | 2/1975 | Sekiguchi et al. | 264/182 |

FOREIGN PATENT DOCUMENTS

| | | | |
|---|---|---|---|
| 48-41033 | 6/1973 | Japan | 264/182 |
| 46-42332 | 12/1971 | Japan | 264/182 |
| 47-34441 | 11/1972 | Japan | 264/182 |

*Primary Examiner*—Jay H. Woo

*Attorney, Agent, or Firm*—Wenderoth, Lind & Ponack

[57] ABSTRACT

Process for producing a flame retardant acrylic fiber by wet-spinning a halogen-containing acrylic spinning solution containing antimony oxide particles dispersed therein, wherein an acrylic fiber having a high degree of flame retardancy and improved fiber properties, such as transparency, luster and brightness of colors of dyed products, is produced in an industrially advantageous manner by regulating the water content in the hydrogel fiber obtained by hot stretching after wet-spinning within a range of 50–130% based on the fiber-forming polymer.

5 Claims, 2 Drawing Figures

PROCESS FOR PRODUCING FLAME RETARDANT ACRYLIC FIBERS WITH IMPROVED PROPERTIES

Figure 1:
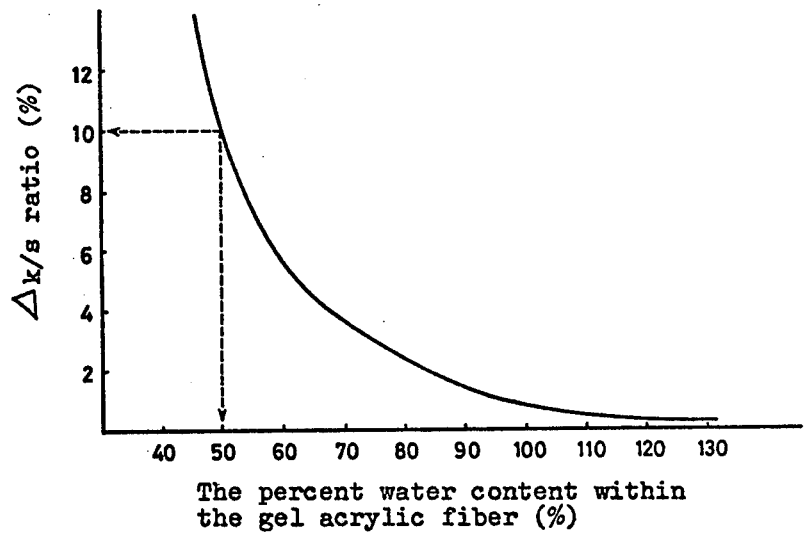

The present invention relates to a process for producing a flame retardant acrylic fiber. More specifically, the invention relates to a process for producing a flame retardant fiber by wet-spinning a halogen-containing acrylic spinning solution containing antimony oxide particles dispersed therein, wherein the acrylic fiber provided with a high degree of flame retardancy and improved fiber properties, such as transparency, luster and brightness of colors of dyed products, is produced in an industrially advantageous manner by regulating the percent water content within the hydrogel fiber obtained by hot stretching after wet-spinning within a specified range by any suitable means.

Acrylic fibers produced from the ordinary acrylonitrile polymers or copolymers have found a wide variety of applications in the field of textile and interior decoration. However, because these fibers are essentially lacking in flame retardancy, it is not desirable to use them in special uses, for example interior decorations such as carpets, curtains, etc. and clothing for babies and children.

In order to overcome this defect of acrylic fibers there have been heretofore employed various methods, such as a method wherein acrylonitrile is copolymerized with a flame retardant monomer such as a halogen-containing unsaturated monomer, a method wherein an acrylonitrile polymer is blendspun with a flame retardant polymer, a method wherein a spinning solution kneaded with a halogen-containing flame retardant is spun, a method wherein the fiber is finished with a flame retardant, etc. Although these conventional flame retardant methods give some degree of flame retardancy to acrylic fiber materials, these methods fail in providing them with a higher flame retardancy. Therefore a method of providing a higher degree of flame retardancy has been proposed wherein a flame retardant synergist such as antimony oxide is introduced, together with a halogen, into acrylic fibers.

Thus, by introducing antimony oxide into acrylic fibers together with halogen, a high degree of flame retardancy can be provided. But such a method has not been sufficient to provide the final fiber with practically satisfactory fiber properties such as transparency, luster and color developing properties, and it has been difficult to produce a flame retardant acrylic fiber product having sufficient value as an article of commerce.

In the light of such circumstances, we made an intensive study to remove these drawbacks inherent in such conventional techniques. As a result, we have found that, in producing a flame retardant acrylic fiber from a halogen-containing acrylic spinning solution containing dispersed antimony oxide particles, when the percent water content within the gel fiber obtained by hot stretching after wet-spinning is maintained within a specified range by suitably regulating the composition of the fiber-forming polymer components and/or the spinning conditions, fiber properties, such as the transparency and luster of the final fiber and the brightness of colors and color development (intensity) of dyed products, can be markedly improved.

A principal object of the present invention is to provide a process for producing a flame retardant acrylic fiber remarkably improved in fiber properties.

Another principal object of the present invention is to produce an acrylic fiber in an industrially advantageous manner which has an excellent transparency and luster and does not cause any decrease in color development due to drying, etc.

Figure 2:
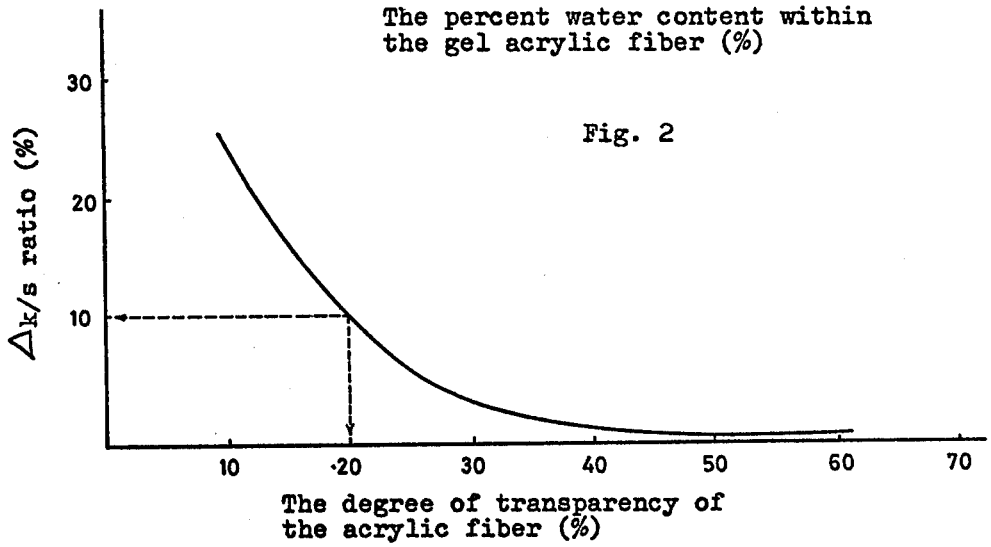

Other objects of the present invention will become apparent from the following concrete explanation of the invention, which will be made by referring to the accompanying drawings wherein:

FIG. 1 exemplifies the relation between the percent water content within the gel acrylic fiber and the degree of deterioration in color development ($\Delta k/s$ ratio) caused by drying, etc.; and FIG. 2 diagrams the relation between the abovementioned degree of deterioration in color development and the degree of transparency of the flame retardant acrylic fiber.

Upon producing a flame retardant acrylic fiber by the ordinary wet-spinning from a halogen-containing acrylic spinning solution prepared by dispersing antimony oxide having a particle diameter less than 100 m$\mu$ into a solvent solution of an acrylonitrile copolymer copolymerized with a halogen-containing unsaturated monomer or of an acrylonitrile composition compounded with a halogen-containing flame retardant component, the above-mentioned objects of the present invention are achieved by regulating the percent water content within the gel fiber obtained by hot stretching after wet-spinning between 50 and 130 weight percent based on the fiber-forming polymer.

The acrylic fiber obtained by the process of the present invention has a high degree of flame retardancy caused by the synergistic effect between halogen and antimony oxide. Moreover, the absence of voids in the fiber results in providing an excellent transparency and luster as well as causing no decrease in the brightness of colors and no lowering of color development due to drying after dyeing, so that the fiber has an extremely high value as an article of commerce.

The especially important point in producing an acrylic fiber having such characteristic fiber properties is to regulate the quantity of water present in the acrylic fiber (i.e. the percent water content within the fiber) in a hydrogel state between 50 and 130 weight percent based on the fiber-forming polymer. To make this clearer, an explanation is given by reference to FIGS. 1 and 2. FIG. 1 is a diagram exemplifying the relation between the percent water content within the acrylic fiber in a gel state and the degree of deterioration in color development (the $\Delta k/s$ ratio, which will be explained later) due to drying, etc. of dyed products of the final fiber. From FIG. 1, it will be understood that, as the quantity of water present in the gel fiber is increased the $\Delta k/s$ ratio is decreased gradually so that the change in color development due to heat, etc. of the final fiber is markedly lessened. In the present invention, it has been confirmed that when the $\Delta k/s$ ratio is less than 10% (when the percent water content within the gel fiber is above 50 weight percent), dyed products of the final fiber do not cause the disadvantages of lowering color development and lowering the brightness of colors by passing through a thermal history such as drying, etc. FIG. 2 diagrams the relation between the $\Delta k/s$ ratio and the degree of transparency of the final fiber. From FIG. 2, it will be clearly understood that with the decrease in the degree of deterioration of color development due to drying, etc. of dyed products (with the increase of the percent water content within the gel fiber), the degree of transparency is increased so that the transparency and luster of the final fiber can be markedly improved. In this connection, it has been confirmed in the present invention that when the degree of transparency is above 20% (when the percent water content within the gel fiber is above 50%), the transparency and luster of the final fiber can be improved. In the case where the percent water content within the acrylic fiber in a gel state exceeds 130 weight percent based on the fiber-forming polymer, troubles may be caused during the production of the flame retardant fiber, such as agglutination between fibers or occurrence of defective yarns (weak yarns), and therefore such a water content is not desirable.

The percent water content within the gel fiber, the degree of transparency and the degree of deterioration in color development (Δk/s ratio) are calculated from the following measurements.

(i) Percent water content within the gel fiber

Acrylic filaments in a gel state are charged into a centrifuge and dehydrated at 3,000 r.p.m. for 2 minutes. Thereafter, the percent water remaining in the gel filaments is measured by the method of weight loss on drying. The value after deduction of a definite value of 10% (residual water which does not participate in the percent water content) from the above-mentioned percent water remaining in the gel filaments is employed.

(ii) Degree of transparency

Finally produced acrylic filaments are cut in 2 mm. lengths. One hundred and five mg. of the cut filaments is dispersed in a solution adjusted to a refractive index of 1.506 obtained by mixing dimethyl phthalate (1.512), acetophenone (1.529) and ethanol (1.358). A definite quantity of the dispersion is placed in a measuring cell (length × width × height = 1 × 1 × 5 cm). A beam of light having a wave length of 420 mμ is projected at right angles against the surface of the cell. From the percent transmission observed, the degree of transparency is evaluated.

(iii) Δk/s Ratio

The fiber for measurement is made to completely absorb 0.5% o.w.f. (on the dry weight of the fiber) of Aizen Catilon Blue K-2 GLH (a cationic dye produced by Hodogaya Chemical Co.). The dyed product is divided into two parts. One is dried at 60° C. for 60 minutes and the other is dried at 120° C. for 15 minutes. The reflection density (k/s value) of each of the two dried dyed products is measured with a Hunter-type reflectometer (Color Machine CM-20 produced by Color Machine K.K.) and the Δk/s ratio is calculated by the following formula:

$$\Delta \frac{k}{s} \text{ Ratio} = \frac{\left(\frac{k}{s}\right)_{120^\circ C} - \left(\frac{k}{s}\right)_{60^\circ C}}{5} \times 100\ (\%)$$

The value of the denominator in the above formula represents the reflection density, obtained according to the above procedure, of the ordinary acrylic fiber. The smaller the Δk/s ratio, the smaller is the degree of deterioration in color development of the final fiber.

The regulation of the percent water content within the acrylic fiber in a gel state is achieved, as has been heretofore known, by combining various conditions including the component composition of the acrylonitrile copolymer or the acrylonitrile polymer composition, the concentration of said copolymer or said composition in the spinning solution, the temperature of the coagulating bath upon spinning, the cold stretching ratio, the hot stretching ratio, etc. Generally, in the case of using aqueous thiocyanate solution as the solvent, an acrylic fiber in a gel state having a desired percent water content can be obtained by regulating the concentration of the copolymer or the composition in the spinning solution between 8.0 and 13.0 weight percent, the coagulating bath temperature upon spinning between −3° C. and 10° C., the cold stretching ratio between 1.5 and 3.0 times and the hot stretching ratio between 1.5 and 10 times, depending on the kind and quantity of the hydrophilic groups (for example sulfonic acid groups, carboxyl groups, amino groups, amide groups, ammonium salt groups, etc.) to be introduced into the fiber-forming polymer. It goes without saying that, also in the case of using any other solvents, the percent water content in the gel fiber can be effectively increased by heightening the quantity of hydrophilic groups introduced into the fiber-forming polymer, or the coagulating bath temperature, or by lowering the polymer concentration in the spinning solution or the cold stretching ratio or the hot stretch ratio, under the abovementioned conditions.

The halogen-containing acrylic solvent solution can be produced by any method, provided that a solvent solution is finally obtained which is composed of an acrylonitrile copolymer copolymerized with a halogen-containing unsaturated monomer or an acrylonitrile polymer composition compounded with a halogen-containing flame retardant component and any of the inorganic acids, inorganic salts or organic solvents which are well known as solvents for acrylonitrile polymers. For example the following methods can be employed: (1) a method wherein an acrylonitrile copolymer obtained by copolymerizing acrylonitrile, a halogen-containing unsaturated monomer and another vinyl monomer copolymerizable with acrylonitrile is dissolved in any of the abovementioned solvents; (2) a method wherein an acrylonitrile polymer is mixed with a homopolymer of a halogen-containing unsaturated monomer or with a copolymer of said monomer copolymerized with acrylonitrile or another vinyl monomer and then the mixture is dissolved in any of the well-known solvents; and (3) a method wherein an acrylonitrile spinning solution prepared by dissolving an acrylonitrile polymer in a solvent is mixed with a halogen-containing organic compound. At this time the polymer or copolymer of the halogen-containing unsaturated monomer or the halogen-containing organic compound mixed as a halogen-containing flame retardant component may be present in a dispersed state in the solvent solution besides being present in a dissolved state, and this does not depart from the spirit of the present invention.

The halogen-containing unsaturated monomers used in the present invention are ethylenically unsaturated compounds containing halogen combined therewith, and include, for example, halogenated unsaturated hydrocarbon monomers such as allyl chloride, allyl bromide, vinyl chloride, vinyl bromide, vinylidene chloride, vinylidene bromide, etc.; halogenated alkyl acrylates or methacrylates represented by 2,3-dichloropropyl ester or 2,3-dibromopropyl ester of acrylic acid or methacrylic acid; halogenated aryl acrylates or methacrylates such as 2,4,6-tribromophenyl acrylate, 2,6-dibromo-4-sulfonic phenyl acrylate and their derivatives; halogenated styrene such as dibromostyrene; nucleus-substituted halogenated alkyl derivatives of styrene such as p-chloromethyl or p-bromomethylstyrene;

halogenated alkyl vinyl ethers such as chloromethyl vinyl ether, bromomethyl vinyl ether, chloroethyl vinyl ether, bromoethyl vinyl ether, 2,3-dichloropropyl vinyl ether, 2,3-dibromopropyl vinyl ether, etc. and corresponding halogenated alkyl allyl ethers; phosphorus- and halogen-containing unsaturated monomers such as bis(2-chloroethyl)vinyl phosphonate, bis(2-bromoethyl)vinyl phosphonate, etc. Among these halogen-containing monomers, it is particularly desirable to use halogenated unsaturated hydrocarbon monomers such as vinyl chloride, vinyl bromide, vinylidene chloride, etc.

Among the halogen-containing organic compounds to be introduced into the acrylic solvent solution, there may be recited well-known halogenated organic compounds, for example, halogenated phosphoric esters or phosphorous esters such as tri(2,3-dibromopropyl)phosphate, tris(2,3-dichloropropyl)phosphate, tris(chlorobromoethyl)phosphate, tri(chlorobromopropyl)phosphate, tris(2-chloroethyl)phosphate, bisdibromopropyldichloropropyl phosphate, bisbromochloropropylbromochloropropyl, phosphonate, bisdibromopropyldibromopropyl phosphonate, bis-2-chloroethylvinyl phosphonate, etc.; halogenated organic phosphorus compounds such as teromers produced from a halomethane and an unsaturated phosphate, and reaction products of an epoxy compound and halogenated phosphorus and/or oxyhalogenated phosphorus, etc.; halogenated aliphatic hydrocarbons such as chlorinated paraffins, etc.; halogenated aromatic hydrocarbons such as hexachlorobenzene, etc.; halogenated aliphatic esters such as methyl pentachlorostearate, methyl decachlorostearate, methyl decachlorolaurate, ethyl pentabromostearate, etc.; halogenated aliphatic amides such as N,N-dimethyl tetrabromostearamide, N,N-dimethyl dibromostearamide, etc.

Other vinyl monomers used in the present invention include vinyl esters, particularly saturated aliphatic monovalent carboxylic acid vinyl esters, for example vinyl acetate, vinyl propionate, vinyl butyrate, etc.; allyl-type alcohols, for example allyl alcohol, methallyl alcohol, ethallyl alcohol, etc.; monobasic acid allyl, methallyl and other unsaturated monohydric alcohol esters, for example allyl and methallyl acetates, laurates, cyanides, etc.; acrylic acid and alkacrylic acids such as methacrylic acid, ethacrylic acid, etc. and esters and amides of such acids, for example methyl, ethyl, propyl, butyl, etc. acrylates and methacrylates, acrylamide, methacrylamide, N-methyl, -ethyl, -propyl, -butyl, etc. acrylamides and methacrylamides, etc.; methacrylonitrile, ethacrylonitrile and other hydrocarbon substituted acrylonitriles; unsaturated sulfonic acids having a single $CH_2{=}C<$ group and their salts, for example allylsulfonic acid, methallylsulfonic acid, styrenesulfonic acid and their sodium, potassium salts; unsaturated aliphatic hydrocarbons having a single $CH_2{=}C<$ group, for example isobutylene, etc.; and various other vinyl, acrylic, etc. compounds having a single $CH_2{=}C<$ group which polymerize with acrylonitrile to produce thermoplastic copolymers.

The quantity of acrylonitrile in these acrylonitrile polymers or copolymers is suitably selected so that at least 40 weight percent, preferably 60 weight percent, combined acrylonitrile is contained in the finally obtained acrylic fiber. Also, the copolymerization ratio of the halogen-containing unsaturated monomers or the quantity of the halogen-containing flame retardant components introduced into the composition is suitably selected so that they are contained in the copolymer or composition in an amount of 3 to 50 weight percent calculated in terms of halogen.

Among the solvents which dissolve the halogen-containing acrylonitrile copolymers or halogen-containing acrylonitrile polymer compositions to form solvent solutions, there may be recited aqueous solutions of inorganic acids such as nitric acid, etc.; concentrated aqueous solutions of inorganic salts, for example thiocyanates such as sodium thiocyanate, potassium thiocyanate, ammonium thiocyanate, etc., perchlorates such as sodium perchlorate, calcium perchlorate, etc.; zinc chloride, lithium chloride, etc., and organic solvents such as dimethylformamide, dimethyl sulfoxide, etc. In this connection, the concentration of the halogen-containing acrylonitrile copolymers or halogen-containing acrylonitrile polymer compositions in the above-mentioned solvent solution can be selected within the usually employed range as referred to earlier, provided that the percent water content within the gel acrylic fiber can be maintained within the prescribed range.

The halogen-containing acrylic spinning solution is prepared by uniformly dispersing antimony oxide into the solvent solution thus prepared. The antimony oxide for use in the present invention must have an average particle diameter less than 100 mμ. Antimony oxide having an average particle in excess of 100 mμ is not desirable, since flame retardant acrylic fibers produced with such antimony oxide is markedly lessened in transparency in boiling water treatment such as dyeing. The antimony oxide used in the present invention can be freely selected from antimony oxides such as antimony trioxide, antimony tetroxide and antimony pentoxide, or hydrates of these antimony oxides. The mixing apparatus for dispersing the antimony oxide into the solvent solution can be freely selected from any known stirring apparatus.

The acrylic spinning solution obtained according to the present invention containing uniformly dispersed antimony oxide is then extruded into a coagulating bath in the usual way to form filaments. The filaments, after passing through the steps of solvent removal, hot stretching, drying for fiber compacting, relaxing heat treatment, etc., are formed into the final fiber. The various conditions employed in the spinning step and post-treatment step are not strictly limited and are suitably selected from the usual process conditions so that the gel fiber after hot stretching can maintain the percent water content within the range in accordance with the present invention.

The acrylic fiber obtained by wet-spinning the halogen-containing acrylic spinning solution containing such antimony oxide particles dispersed therein, in addition to its having a high degree of flame retardancy, is remarkably improved in the transparency, luster and color developing properties of the final fiber, without causing any troubles in the process, by regulating the percent water content within the gel acrylic fiber obtained by hot stretching after wet-spinning within the prescribed range. Its characteristic features are emphasized also in comparison with conventional flame retardant acrylic fibers.

The following examples are given for a better explanation of the present invention and are not intended to limit the scope of the invention. All parts and percentages in the examples are by weight unless otherwise specified.

EXAMPLE 1

Particles of antimony oxide having an average particle diameter of 14 mμ were continuously introduced into a 50% aqueous sodium thiocyanate solution of an acrylonitrile copolymer (polymer concentration: 10%) consisting of 82.7% acrylonitrile, 9% vinylidene chloride, 8% methyl acrylate and 0.3% sodium methallysulfonate so that the particles constitute 5.3% based on the weight of the copolymer. The mixture was then blended by stirring with a Pipeline Homomixer (produced by Tokushu Kikako Co.) whereby an acrylic spinning solution containing finely and uniformly dispersed antimony oxide was obtained continuously and stably.

The spinning solution thus obtained was extruded into a coagulating bath of a 12% aqueous sodium thiocyanate solution through a spinnerette having 5028 orifices, each 0.14 mm in diameter. The coagulated filaments were stretched 2.5 times the length at room temperature and then washed with water. The filaments in a hydrogel state were stretched 4.8 times in boiling water. Subsequently, the filaments were subjected to drying for fiber compacting at a temperature of 125° C. and to wet-heat relaxing treatment in saturated steam at 128° C. to produce the final fiber. The percent water content within the fiber after hot stretching was measured and found to be 64% based on the fiber-forming polymer. The final fiber was substantially free from voids, and therefore no substantial devitrification (loss of transparency) was observed. Moreover, it had a good luster and did not show any deterioration in color development of dyed products. Thus, it had a high value as an article of commerce. FIG. 1 shows fiber properties of the flame retardant acrylic fiber obtained by the above-mentioned procedure.

On the other hand, a comparative test was carried out, in which the same antimony oxide particles as above were continuously introduced into an aqueous 50% sodium thiocyanate solution of an acrylonitrile copolymer (polymer concentration: 10%) consisting of 83.5% acrylonitrile, 7.3% methyl acrylate and 8.8% vinylidene chloride (thus containing no copolymer component having hydrophilic groups). Thereafter, by the same procedure and under the same conditions as above, wet-spinning, cold stretching, hot stretching, drying for fiber compacting and relaxing heat treatment were carried out to produce the final fiber. The percent water content within the gel acrylic fiber by this procedure and fiber properties of the thus obtained flame retardant acrylic fiber are given together in Table 1.

Table 1

| | Acrylonitrile copolymer composition | Water content within gel fiber (%) | Degree of transparency (%) | Δk/s Ratio (%) |
|---|---|---|---|---|
| Present invention | containing hydrophilic groups | 64 | 24 | 4.5 |
| Comparative example | containing no hydrophilic groups | 48 | 18 | 11 |

As apparent from the results shown in Table 1, by changing only the content of the hydrophilic groups introduced into the fiber-forming polymer so as to regulate the percent water content in the hydrogel acrylic fiber within the range recommended in the present invention, a flame retardant acrylic fiber was obtained which had a reduced loss of transparency and a good luster and was substantially free from deterioration in color development,

EXAMPLE 2

An acrylic spinning solution containing finely dispersed antimony oxide was obtained by the same procedure as in Example 1, using a 50% aqueous sodium thiocyanate solution of an acrylonitrile copolymer consisting of 83.8% acrylonitrile, 6.7% methyl acrylate, 8.8% vinylidene chloride and 0.7% sodium methallylsulfonate, said solution having a polymer concentration regulated 9.5%. From the spinning solution thus obtained, the final fiber was obtained through the steps of wet-spinning, cold stretching, hot stretching, drying for fiber compacting and relaxing heat treatment under the same conditions as in Example 1. The percent water content within the gel acrylic fiber prepared by this procedure and fiber properties of the flame retardant acrylic fiber thus obtained are described in Table 2.

As a comparative example, the same procedure as above was followed except that the acrylonitrile copolymer concentration was changed to 10.5%, to produce the final fiber. The percent water content within the gel acrylic fiber by this procedure and fiber properties of the flame retardant acrylic fiber thus obtained are also given in Table 2.

Table 2

| | Polymer concentration (%) | Water content within gel fiber (%) | Degree of transparency (%) | Δk/s Ratio (%) |
|---|---|---|---|---|
| Present invention | 9.5 | 68 | 31 | 4.0 |
| Comparative example | 10.5 | 41 | 11 | 18 |

As apparent from the results given in Table 2, by changing only the polymer concentration in the spinning solution so as to regulate the percent water content in the gel acrylic fiber within the range recommended in the present invention, a flame retardant acrylic fiber was obtained which had an excellent transparency and luster and was substantially free from deterioration in color development.

EXAMPLE 3

An acrylic spinning solution having a polymer concentration of 10% and containing finely dispersed antimony oxide was produced by using the same antimony oxide as in Example 1 and an acrylonitrile copolymer having the same composition as in Example 2, under the same stirring means as in Example 1. The thus obtained spinning solution was extruded through the same spinnerette as in Example 1 into a coagulating bath of a 12% aqueous sodium thiocyanate solution so as to be coagulated into filaments. Thereafter, the filaments were subjected to the same post-treatments as in Example 1 to form the final fiber. The percent water content within the gel fiber after hot stretching was measured and found to be 110% based on the fiber-forming polymer. The final fiber was free from voids and had a good luster, so that it was valued highly as an article of commerce. Fiber properties of the flame retardant acrylic fiber obtained by this procedure are shown in Table 3.

On the other hand, a comparative example was performed, in which the final fiber was produced in the same procedure except that the coagulating bath temperature upon spinning was changed to −3° C. The percent water content within the gel acrylic fiber by this procedure and properties of the flame retardant acrylic fiber thus obtained are also given in Table 3.

Table 3

| | Coagulating bath temperature | Water content within gel acrylic fiber (%) | Degree of transparency (%) | Δk/s Ratio (%) |
|---|---|---|---|---|
| Present invention | 2° C. | 110 | 39 | 1.0 |
| Comparative example | −3° C. | 49 | 19 | 9.8 |

As apparent from Table 3, by changing the coagulating bath temperature so as to regulate the percent water content in the hydrogel acrylic fiber within the prescribed range, a flame retardant acrylic fiber improved in fiber properties was produced.

What we claim is:

1. A process for producing a flame retardant acrylic fiber which comprises dispersing antimony oxide particles having a particle diameter of less than 100 mμ into a solution of (A) a copolymer containing units of acrylonitrile, 0.3 to 0.3% by weight of a sulfonic acid group- or sulfonate group-containing unsaturated monomer and a halogen-containing unsaturated monomer or (B) a composition containing a halogen-containing flame retardant component and a copolymer containing units of acrylonitrile and 0.3 to 0.7% by weight of a sulfonic acid group- or sulfonate group-containing unsaturated monomer, to prepare a spinning solution having a concentration of said copolymer (A) or said composition (B) of 8 to 13% by weight, wet-spinning the spinning solution into a coagulation bath having a temperature of −3° to 10° C to obtain filaments, cold-stretching the filaments at a ratio of 1.5 to 3.0 times, hot-stretching the cold stretched filaments at a ratio of 1.5 to 10 times to obtain gel filaments having a water content of 50 to 130% by weight based on the weight of the fiber-forming polymer components, drying the gel filaments to compact the filaments, and subjecting the dried filaments to a heat-relaxing treatment.

2. A process as claimed in claim 1 wherein the halogen-containing unsaturated monomer is a halogen-containing unsaturated hydrocarbon monomer.

3. A process as claimed in claim 2 wherein the halogen-containing unsaturated hyrocarbon monomer is selected from the group consisting of vinyl chloride, vinyl bromide and vinylidene chloride.

4. A process as claimed in claim 1 wherein the acrylic fiber contains at least 40% by weight of acrylonitrile.

5. A process as claimed in claim 1 wherein the acrylic fiber contains 3 - 50% by weight of halogen-containing unsaturated monomer or halogen-containing flame retardant component, calculated as halogen.

* * * * *